US007936260B2

(12) United States Patent
Williamson et al.

(10) Patent No.: US 7,936,260 B2
(45) Date of Patent: May 3, 2011

(54) IDENTIFYING REDUNDANT ALARMS BY DETERMINING COEFFICIENTS OF CORRELATION BETWEEN ALARM CATEGORIES

(75) Inventors: David M. Williamson, Hazlet, NJ (US); Michael Sidey, Middletown, NJ (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 289 days.

(21) Appl. No.: 12/265,195

(22) Filed: Nov. 5, 2008

(65) Prior Publication Data

US 2010/0109860 A1 May 6, 2010

(51) Int. Cl.
*G08B 29/00* (2006.01)

(52) U.S. Cl. ..... 340/508; 340/506; 340/511; 340/3.1

(58) Field of Classification Search ..... 340/506, 340/507, 511, 3.1, 825.36, 825.49
See application file for complete search history.

(56) References Cited

U.S. PATENT DOCUMENTS 4,367,458 A * 1/1983 Hackett ..... 340/539.16
4,520,481 A * 5/1985 Israel ..... 714/775
5,159,685 A * 10/1992 Kung ..... 714/26
5,259,766 A * 11/1993 Sack et al. ..... 434/362
6,715,101 B2 * 3/2004 Oldfield et al. ..... 714/11
2004/0133672 A1 7/2004 Bhattacharya et al.
2004/0153693 A1 8/2004 Fisher et al.
2005/0222810 A1 10/2005 Buford et al.
2007/0177523 A1 8/2007 Nagami et al.
2007/0234102 A1 10/2007 Fan et al.
2008/0016412 A1 1/2008 White et al.
2008/0319940 A1 12/2008 Garg et al.
2008/0320338 A1 12/2008 Ward
2009/0070628 A1 3/2009 Gupta et al.
2009/0182794 A1 7/2009 Sekiguchi

OTHER PUBLICATIONS

U.S. Appl. No. 12/255,149, filed Oct. 21, 2008 entitled "Filtering Redundant Events Based on a Statistical Correlation Between Events" Inventors: Lev Slutsman and Moshiur Rahman.
U.S. Official Action dated Feb. 3, 2011 in U.S. Appl. No. 12/255,149.

* cited by examiner

*Primary Examiner* — Daryl Pope
(74) *Attorney, Agent, or Firm* — Hope Baldauff Hartman, LLC

(57) ABSTRACT

Methods, systems, and computer-readable media for identifying potentially redundant alarms based on a statistical correlation calculated between categories of alarms are provided. Each alarm in a compilation of alarm history data is assigned to an alarm category. A coefficient of correlation is computed between each distinct pair of alarm categories that indicates the probability that an alarm assigned to the second category of the pair occurs coincidentally within the alarm history data with an alarm assigned to the first category of the pair, given that an alarm assigned to the first category has occurred. Finally, a list of potentially redundant alarms is created consisting of pairs of alarm categories having a coefficient of correlation equal to or exceeding a threshold value.

20 Claims, 5 Drawing Sheets

IDENTIFYING REDUNDANT ALARMS BY DETERMINING COEFFICIENTS OF CORRELATION BETWEEN ALARM CATEGORIES

BACKGROUND

This disclosure relates generally to the field of system management and troubleshooting. More specifically, the disclosure provided herein relates to strategies for reducing the number of alarms requiring investigation in a production network environment or other complex system.

A major cost driver in the operation of a large, complex system of networked devices or components is having sufficient support personnel to address the large number of problems or faults that may occur in such as system. In many cases, these problems must be identified by analyzing a stream of "alarms" or fault events that are generated by the myriad of devices and components that make up the system infrastructure. To manage the system efficiently, a strategy may be employed to reduce the total number of alarms that must be presented to support personnel for diagnosis and troubleshooting.

One element of such an alarm reduction strategy may be to identify and reduce redundant alarms, or those alarms having the same root cause. This allows support personnel to concentrate on solving the problem rather than spend time investigating duplicate notifications. However, identifying redundant alarms normally requires a detailed knowledge and thorough analysis of the types of interconnected devices and components from which the system is constructed.

SUMMARY

It should be appreciated that this Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Embodiments of the disclosure presented herein include methods, systems, and computer-readable media for identifying potentially redundant alarms based on a statistical correlation calculated between categories of alarms. According to aspects, each alarm in a compilation of alarm history data is assigned to an alarm category. A coefficient of correlation is computed between each distinct pair of alarm categories that indicates the probability that an alarm assigned to the second category of the pair occurs coincidentally within the alarm history data with an alarm assigned to the first category of the pair, given that an alarm assigned to the first category has occurred. Two alarms in the alarm history data are considered to have occurred coincidentally with each other if the time of occurrence of the first alarm is within an incident interval before or after the time of occurrence of the second alarm. Finally, a list of potentially redundant alarms is created consisting of pairs of alarm categories having a coefficient of correlation equal to or exceeding a threshold value.

Other systems, methods, and/or computer program products according to embodiments will be or become apparent to one with skill in the art upon review of the following drawings and detailed description. It is intended that all such additional systems, methods, and/or computer program products be included within this description, be within the scope of the present invention, and be protected by the accompanying claims.

DETAILED DESCRIPTION

Figure 1:
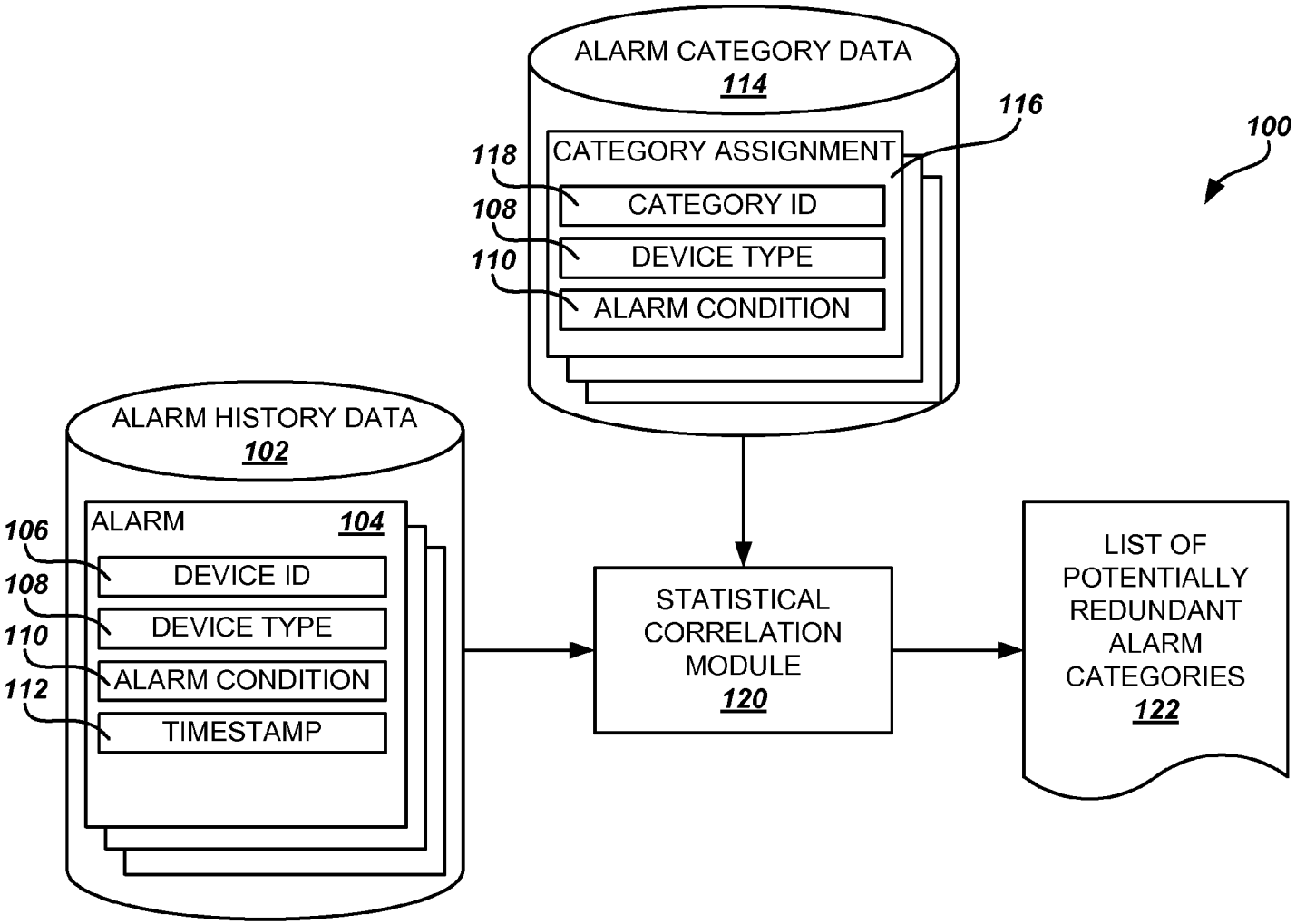
FIG. 1 is a block diagram illustrating an operating environment for identifying potentially redundant alarms based on a statistical correlation between categories of alarms, in accordance with exemplary embodiments.

The following detailed description is directed to methods, systems, and computer-readable media for identifying potentially redundant alarms in alarm history data by computing a statistical correlation between categories of alarms. Utilizing the technologies described herein, a list of potentially redundant alarms can be generated for further investigation by utilizing statistical analysis of historical alarm data, without requiring an understanding of the interaction of the various alarms or a detailed knowledge of the devices, components and associated infrastructure that generated the alarms.

Throughout this disclosure, embodiments may be described with respect to alarms generated by devices located on a network. While alarms generated by networked devices provide a useful example for embodiments described herein, it should be understood that the concepts presented herein are equally applicable to events occurring in other systems consisting of a number of individual components or complex mechanisms. Such systems may include, but are not limited to, a computer server, a system of highways or roadways, an air transportation system, or a factory assembly line.

In the following detailed description, references are made to the accompanying drawings that form a part hereof, and that show by way of illustration specific embodiments or examples. In referring to the drawings, it is to be understood that like numerals represent like elements through the several figures, and that not all components described and illustrated with reference to the figures are required for all embodiments.

Referring now to FIG. 1, an illustrative operating environment 100 and several software components for generating a list of potentially redundant alarms is shown, according to embodiments. The environment 100 includes alarm history data 102. The alarm history data 102 consists of alarm records 104 representing individual alarms or other events captured over a period of time from a stream of alarms or events generated by devices or components comprising a network or other complex system. For example, the alarm history data 102 may contain hundreds of thousands of alarm records 104 collected over a two year period from devices in a complex network operated by a network service provider.

Each alarm record 104 may include a device ID 106 identifying the device or component that generated the alarm, a device type 108 identifying the type of the device or component that generated the alarm, an alarm condition 110 indicating the type of condition represented by the alarm, and a timestamp 112. According to one embodiment, the timestamp 112 may indicate the time when the alarm occurred. In another embodiment, the timestamp 112 may indicate the time when the alarm was received by an alarm management system. The alarm history data 102 may be stored in a database to permit statistical computations to be carried out against the data as well as allow other analysis and reporting to be performed.

The environment 100 may also include alarm category data 114 which defines a number of categories of alarms. The alarm category data 114 provides a mechanism for categorizing the alarms in the alarm history data 102 for the computation of the coefficients of correlation between alarm categories, as will be described in detail below in regard to FIG. 2. In one embodiment, the alarm category data 114 consists of one or more category assignments 116. Each category assignment 116 specifies that a particular category, indicated by a category ID 118, is to be assigned to alarms having a particular device type 108, a particular alarm condition 110, or both.

For example, a category assignment 116 may exist in the alarm category data assigning a specific category, indicated by the category ID 118, to each individual alarm condition 110 represented in the alarm history data 102. In another example, a category assignment 116 may exist in the alarm category data assigning a specific category to each unique combination of device type 108 and alarm condition 110 represented in the alarm history data 102. As will be appreciated, multiple category assignments 116 may exist in the alarm category data 114 with the same category ID 118, indicating the same category is to be assigned to different combinations of device types, indicated by the device type 108, and/or alarm conditions, indicated by the alarm condition 110. It will further be appreciated that other methods of categorizing alarms may be imagined beyond the mechanism described above, and this application is intended to cover all such methods of categorizing alarms.

According to embodiments, the environment 100 further includes a statistical correlation module 120 which utilizes the alarm history data 102 to compute coefficients of correlation between the alarm categories defined in the alarm category data 114, as will be described in detail below in regard to FIG. 2. The statistical correlation module 120 may be an application software module executing on a general purpose computer, such as the computer described below in regard to FIG. 5, or it may be a specialty device located within the network or system from which the alarms were generated. The statistical correlation module 120 may access the alarm history data 102 and the alarm category data 114 through a database engine.

The statistical correlation module 120 produces a list of potentially redundant alarm categories 122. As will be described in detail below in regard to FIG. 2, the list of potentially redundant alarm categories 122 is a list of alarm category pairs for which the statistical correlation module 120 has computed a high level of correlation, i.e. an alarm of the second category of the pair is likely to occur coincidently in the alarm history data 102 with an alarm of the first category given that the alarm of the first category of the pair has occurred, according to one embodiment. The pairs of alarm categories in the list of potentially redundant alarm categories 122 are good candidates for further investigation to determine if alarms of one of the alarm categories are redundant, i.e. alarms from one of the categories are likely caused by the same root cause as alarms from the other category. Alarms of categories identified to be redundant may be removed from the alarm stream, since if an alarm of the non-redundant category is investigated and the root cause is removed, there is a high likelihood that the alarm of the redundant category will be resolved as well.

Figure 2:
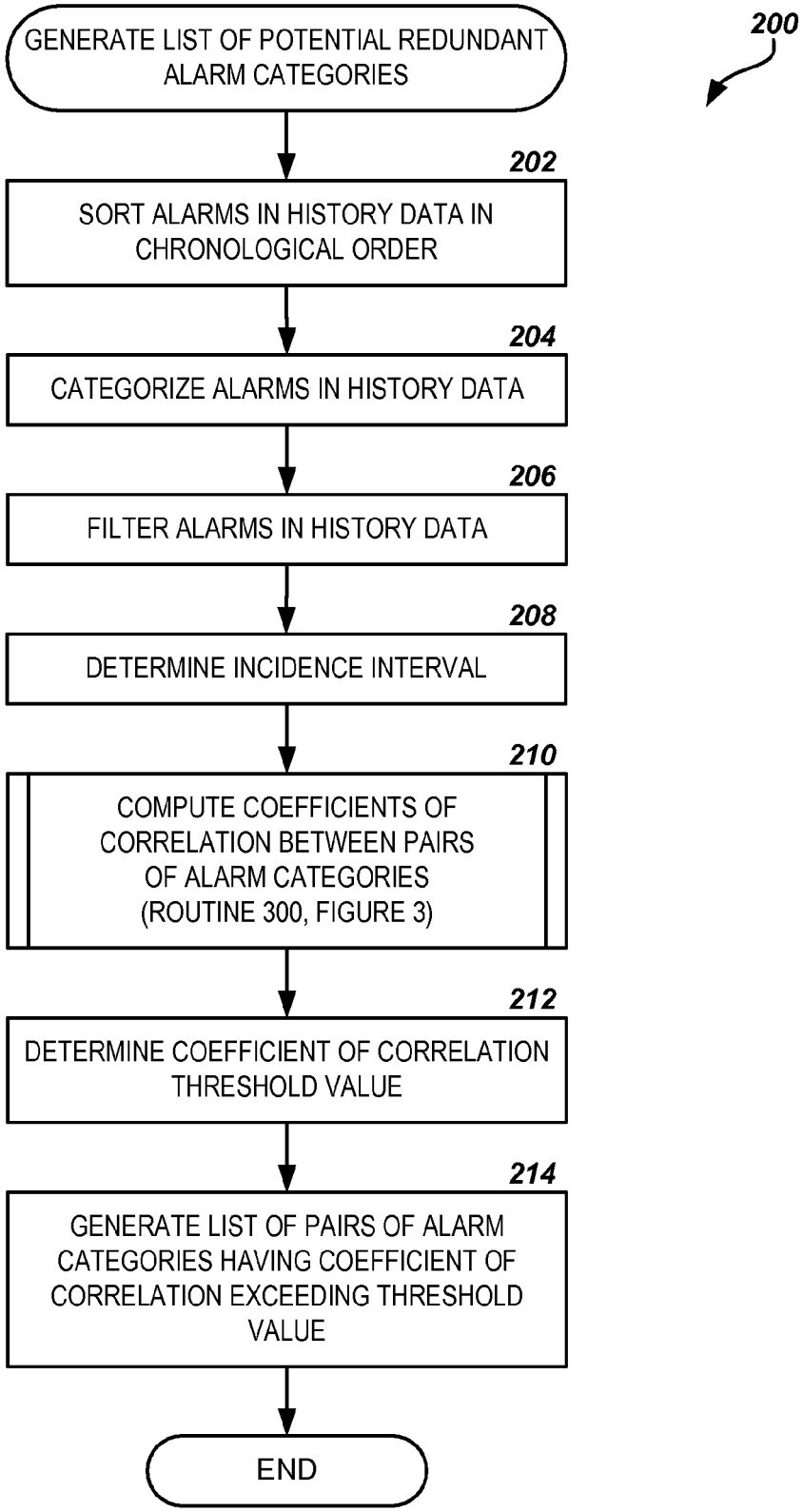
FIG. 2 is a flow diagram illustrating one method for generating a list of potentially redundant alarms based on a statistical correlation between categories of alarms, in accordance with exemplary embodiments.
Figure 3:
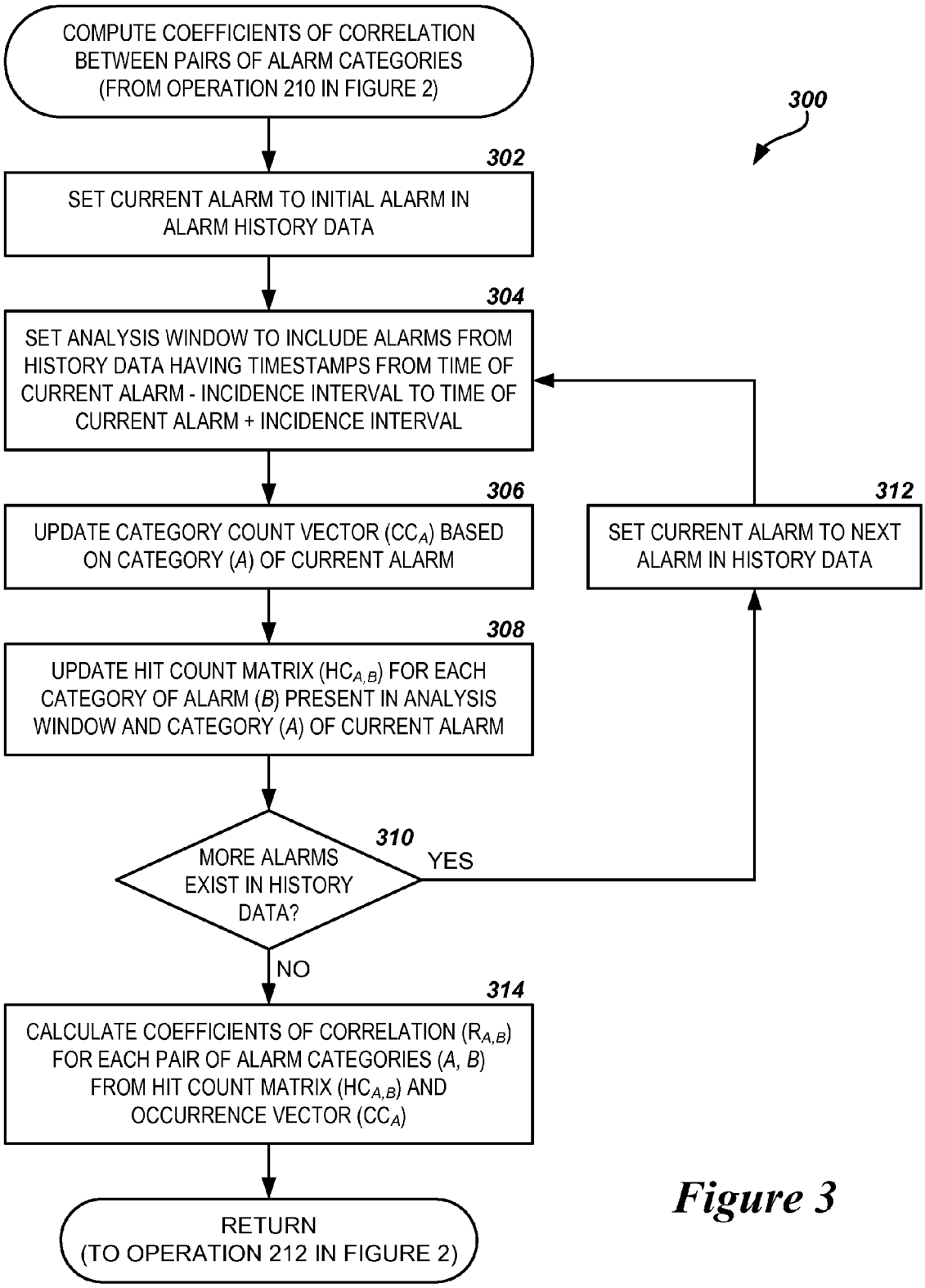
FIG. 3 is a flow diagram illustrating one method for computing coefficients of correlation between pairs of alarm categories, in accordance with exemplary embodiments.

Referring now to FIGS. 2 and 3, additional aspects regarding the operation of the components and software modules described above in regard to FIG. 1 will be provided. It should be appreciated that the logical operations described herein are implemented (1) as a sequence of computer implemented acts or program modules running on a computing system and/or (2) as interconnected machine logic circuits or circuit modules within the computing system. The implementation is a matter of choice dependent on the performance and other requirements of the computing system. Accordingly, the logical operations described herein are referred to variously as operations, structural devices, acts, or modules. These operations, structural devices, acts, and modules may be implemented in software, in firmware, in special purpose digital logic, and any combination thereof.

It should also be appreciated that, while the operations are depicted in FIGS. 2 and 3 as occurring in a sequence, various operations described herein may be performed by different components or modules at different times. In addition, more or fewer operations may be performed than shown, and the operations may be performed in a different order than illustrated in FIGS. 2 and 3.

FIG. 2 illustrates an exemplary routine 200 for generating a list of potentially redundant alarms based on a statistical correlation between categories of alarms, according to embodiments. The routine 200 begins at operation 202, where the statistical correlation module 120 sorts the alarm records 104 in the alarm history data 102 in chronological order. The alarm records 104 may be sorted by the timestamp 112. Because the computation of the statistical correlation requires determining those alarms that occurred within close temporal proximity to each other, sorting the alarm records 104 in chronological order allows for more efficient processing of the alarms in the alarm history data 102 during computations, as will be described in detail below in regard to FIG. 3.

From operation 202, the routine 200 proceeds to operation 204 where the statistical correlation module 120 categorizes the alarms in the alarm history data 102 based on the category assignments 116 contained in the alarm category data 114. As discussed above, all alarms in the alarm history data 102 having a specific alarm condition 110 may be assigned to a particular category, or each unique combination of device type 108 and alarm condition 110 may be assigned to a particular category. The method selected for categorization of the alarms in the alarm history data 102 may depend on a number of factors, including, but not limited to, the number of different types of devices generating alarms, the number of alarm conditions represented in the data, and the scope of the various alarm conditions. If the categories selected are too broad, then many categories of alarms may be determined to be correlated, making the resulting list of potentially redundant alarm categories 122 larger and investigation of the redundant alarms more difficult and less productive. If the categories are too narrow, then the process may produce few if any redundant alarm categories.

The routine 200 then proceeds from operation 204 to operation 206, where the statistical correlation module 120 filters the alarm records 104 in the alarm history data 102 by excluding alarms assigned to certain categories from the computational process, according to one embodiment. For example, alarm categories known to occur frequently in the alarm history data 102, such as heartbeat alarms, are excluded from the analysis, since the frequency may result in this alarm category being highly correlated with other categories. In another example, alarm categories that occur very infrequently in the alarm history data 102 may also be excluded, since the low occurrence of these alarms may make any statistical correlation found for the alarm category unreliable. In addition, there may be minimal advantage to reducing redundant alarms of these categories because they occur infrequently. It will be appreciated by one skilled in the art that other methods of filtering the alarms in the alarm history data 102 before computational processing may be imagined beyond those described above, and this application is intended to cover all such methods of filtering alarms.

By filtering the alarms of these categories from the alarm history data 102 before computing the coefficients of correlation between categories, the overall computational process may be made more efficient. In another embodiment, the alarms assigned to the excluded categories may be included in the computational process, but the categories may be removed from the results before generating the list of potentially redundant alarm categories 122.

From operation 206, the routine 200 proceeds to operation 208, where an incidence interval is determined. The incidence interval defines the amount of time that is allowed to pass between two alarms in the alarm history data 102 while still considering the alarms to be coincident, i.e. having occurred at the same time, as will be described in more detail below in regard to FIG. 3.

According to one embodiment, the appropriate value for the incidence interval is an interval just long enough to account for the expected variability in the timestamp 112 of coincidental alarms in the alarm history data 102. This variability may be caused by a number of factors, including, but not limited to, offsets in polling intervals of the log files of devices generating the coincidental alarms, real time clock drift between individual devices or between the devices and a central collector receiving the alarm stream, and dissimilar network delays between devices on disparate networks and the central collector. For example, an incidence interval of 2 minutes may be chosen.

In another embodiment, the value for the incidence interval may be set to a wider time window in order to discover correlations between alarms that do not occur simultaneously yet may be, nonetheless, related. For example, a particular device within a system may begin to report a low memory condition, which is followed by a failure of the device 20 minutes later. Other devices or components in the system that rely on the failed device may then begin to report related failure conditions. In this example, an incidence interval of at least 20 minutes would be required to capture the correlation between the low memory alarm and the other failure alarms ultimately dependent on the low memory alarm.

The routine 200 then proceeds from operation 208 to operation 210, where the statistical correlation module 120 computes the coefficients of correlation between pairs of alarm categories, utilizing the sorted and filtered alarm history data 102, the alarm category data 114, and the incidence interval determined in operation 208 above, as will be described in detail below in regard to FIG. 3. According to embodiments, a coefficient of correlation is computed for each distinct pair of alarm categories defined in the alarm category data 114 having corresponding alarms in the alarm history data 102. In one embodiment, the coefficient of correlation between two alarm categories, category A and category B, represents the observed probability that an alarm of category B is found in the alarm history data 102 to have occurred within the incidence interval of an alarm of category A, given that an alarm of category A has occurred in the alarm history data.

Next, the routine 200 proceeds from operation 210 to operation 212, where a threshold value for the coefficients of correlation is determined. The threshold value is used to identify correlated alarm category pairs that are candidates for further investigation to determine if the alarms of these categories are redundant. According to one embodiment, the desired threshold value is determined such that the amount of time spent investigating alarm category pairs that are subsequently determined to be unrelated is less than the amount of time that will be saved by eliminating the redundant alarms discovered.

The appropriate threshold value may be determined by a number of methods. For example, the threshold may be set to a value such that a certain percentage of the total number of alarm categories present in the alarm history data 102 are identified as candidates, such as 5%. Or, the threshold value may be set to return a specific number of candidates based on limitations on the number of investigations that may be performed. In a further example, the threshold value may be set to a level determined from previous investigations to represent a minimal coefficient of correlation between alarm categories that likely represents redundant alarms. It will be appreciated that many other methods of determining the threshold value may be imagined than those described herein, and this application is intended to cover all such methods of determining the appropriate threshold value.

From operation 212, the routine 200 proceeds to operation 214, where the statistical correlation module 120 generates the list of potentially redundant alarm categories 122 consisting of pairs of alarm categories having coefficients of correlation greater than the threshold value selected in operation 212. As discussed above in regard to FIG. 1, the list of potentially redundant alarm categories 122 may be further investigated to determine whether the alarms of one of the pair of categories are redundant, and thus can be removed from the alarm stream.

FIG. 3 illustrates an exemplary routine 300 for computing the coefficients of correlation between pairs of alarm categories based on the alarms in the alarm history data 102 and the assigned categories for each alarm from operation 204 described above. As discussed above, the coefficient of correlation computed by routine 300 between two alarm categories, category A and category B, represents the observed probability that an alarm of category B is found in the alarm history data 102 to have occurred within the incidence interval of an alarm of category A, given that an alarm of category A has occurred in the alarm history data. The results of the computation may be contained in a matrix designated $R_{A,B}$, A=1, 2, . . . N, B=1, 2, . . . N, where N is the number of unique alarm categories defined in the alarm category data 114, and $R_{A,B}$ is the coefficient of correlation calculated for the pair of alarm categories A and B.

The routine 300 begins at operation 302, where the statistical correlation module 120 selects the initial alarm from the alarm history data 102 with which to begin the computational process. According to one embodiment, this is accomplished by retrieving from the alarm history data 102 all alarm records 104 having a timestamp 112 less than the timestamp value of the very first alarm record 104 in the alarm history data 102 plus the value of the incidence interval determined in operation 208 described above. The last alarm record 104 retrieved from the alarm history data 102 represents the initial alarm with which to begin the computational process, or the "current alarm".

Figure 4A:
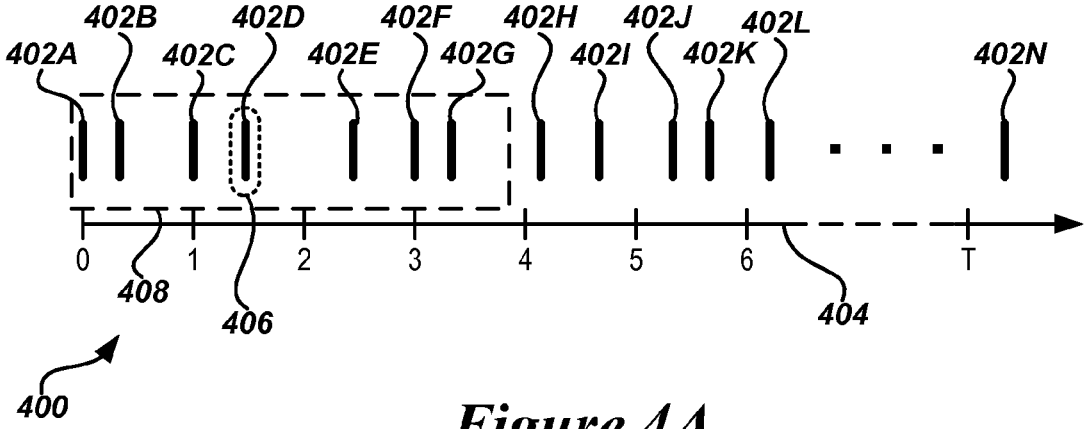
FIGS. 4A-4B are diagrams showing further details of a method for computing coefficients of correlation between pairs of alarm categories, in accordance with exemplary embodiments.

FIG. 4A provides a further illustration of the operation 302. FIG. 4A is a timeline chart 400 showing tick marks 402A-402N representing alarm records 104 from the alarm history data 102 plotted along a time axis 404 in a position corresponding to the timestamp 112 of each alarm record. For purposes of illustration, the very first alarm record 104 in the alarm history data 102, represented by the tick mark 402A, is considered to occur at time T=0. In order to select the initial alarm record 104 with which to begin the computational process, the statistical correlation module 120 retrieves alarm records in chronological order form the alarm history data 102 until the incidence interval is exceeded. The last alarm record 104 retrieved is set to the current alarm. For example, using an incident interval of 2 minutes, the alarm records 104 represented by the tick marks 402A-402D are retrieved from the alarm history data 102. The data from the retrieved alarm records 104 may be stored by the statistical correlation module 120 in a deque or some other structure in memory. A current alarm 406 is then set to the last alarm record 104 retrieved, represented by the tick mark 402D, as further illustrated in FIG. 4A.

The routine 300 proceeds from operation 302 to operation 304 where the statistical correlation module 120 establishes an analysis window 408 which includes all alarm records 104 from the alarm history data 102 having a timestamp 112 within the incidence interval before or after the current alarm 406. As further illustrated in FIG. 4A, for an incidence interval of 2 minutes, the analysis window 408 would include the alarm records 104 represented by the tick marks 402A-402G. The statistical correlation module 120 may establish the analysis window by continuing to retrieve alarm records 104 from the alarm history data 102 and store them in the deque until the incidence interval is again exceeded. The resulting analysis window 408 will have the current alarm 406 approximately in the center of the window.

From operation 304, the routine 300 proceeds to operation 306 where the statistical correlation module 120 increments a category count for the alarm category of the current alarm 406. The category counts may be stored in a category count vector $CC_A$ for each alarm category A, where A=1, 2, . . . N. Next, at operation 308, the statistical correlation module 120 analyzes the alarms records 104 included in the analysis window 408 and increments hit counts for each alarm category having an alarm occurring coincidently with the current alarm 406, i.e. having an alarm record 104 included in the analysis window 408. The hit counts may be similarly stored in a hit count matrix $HC_{A,B}$ for each distinct pairing of the alarm category of the current alarm A, where A=1, 2, . . . N, with the alarm category of the observed alarm in the analysis window B, where B=1, 2, . . . N. According to one embodiment, the hit count matrix $HC_{A,B}$ is only incremented once for each distinct alarm category having an alarm occurring coincidently with the current alarm 406. That is, even if two alarm records in the analysis window 408 are assigned to the same alarm category, the hit count for that alarm category will only be incremented once.

Figure 4B:
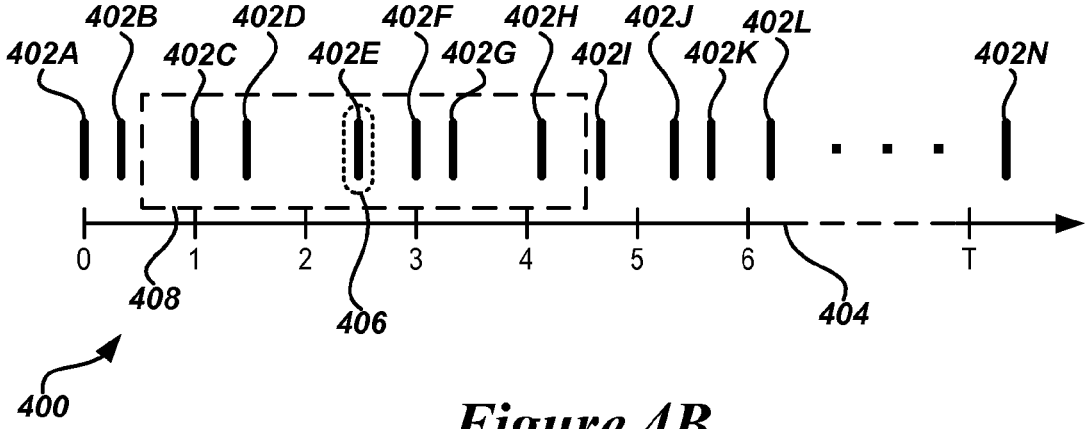

The routine 300 then proceeds from operation 308 to operation 310, where the statistical correlation module 120 determines if there are additional alarm records 104 in the alarm history data 102 beyond the current alarm 406. If there are additional alarm records 104 in the alarm history data 102, the routine 300 proceeds to operation 312 where the statistical correlation module 120 sets the current alarm 406 to the next alarm record in the alarm history data 102. For example, as illustrated in FIG. 4B, the statistical correlation module 120 will set the current alarm 406 to the next alarm record 104 in the alarm history data 102, represented by the tick mark 402E.

From operation 312, the routine 300 returns to operation 304, where the statistical correlation module 120 adjusts the analysis window 408 to include all alarm records 104 from the alarm history data 102 having a timestamp 112 within the incidence interval before or after the new current alarm 406. As further illustrated in FIG. 4B, this may be accomplished by removing from the beginning of the deque those alarm records 104 occurring prior to the current alarm 406 minus the incidence interval, represented by the tick marks 402A and 402B, and retrieving into the deque those alarm records occurring within the incidence interval of the current alarm 406, represented by the tick mark 402H. In effect, the statistical correlation module 120 slides the analysis window 408 forward to be centered around the new current alarm 406, resulting in an analysis window containing alarm records 104 represented by the tick marks 402C-402H. From operation 304, the computational process continues iteratively until the alarm records 104 in the alarm history data 102 have been exhausted.

If, at operation 310, no additional alarm records 104 remain in the alarm history data 102 for analysis, the routine 300 proceeds to operation 314 where the statistical correlation module 120 calculates the coefficients of correlation $R_{A,B}$ for each distinct pair of alarm categories defined in the alarm category data 114. In one embodiment, the coefficient of correlation $R_{A,B}$ between a distinct pair of alarm categories A and B is calculated by dividing the number of times an alarm of category B occurred coincidentally with an alarm of category A by the number of times an alarm of category A occurred in the alarm history data 102. In other words:

$$R_{A,B} = \frac{HC_{A,B}}{CC_A}$$

for each distinct pair of alarm categories A and B, A=1, 2, . . . N, B=1, 2, . . . N. The statistical correlation module 120 may store the resulting matrix $R_{A,B}$ in a table in internal memory. It will be appreciated that, using the computational model described above, $R_{A,B}$ will not necessarily equal $R_{B,A}$ and that the values of $R_{A,B}$ and $R_{B,A}$ represent two separate and distinct data points in the resulting matrix.

According to further embodiments, the coefficient of correlation $R_{A,B}$ may be weighted in such a way that certain conditions or relationships between alarm categories appear in the list of potentially redundant alarm categories 122 above others. For example, the coefficient of correlation $R_{A,B}$ may be weighted by the number of occurrences of alarms of category A in the alarm history data 102. In this way, highly correlated alarms categories with alarms occurring more frequently in the alarm history data will be given more weight than alarms occurring less frequently. In another example, alarms categories having alarms occurring closer together in the alarm history data 102 may be weighted more heavily than alarm categories having alarms occurring farther apart. Alternatively, a pair of alarm categories having alarms occurring at a consistent interval apart or occurring in the same order may have their coefficient of correlation $R_{A,B}$ weighted more heavily than others. From operation 314, the routine 300 returns to operation 212 described in regard to FIG. 2.

Figure 5:
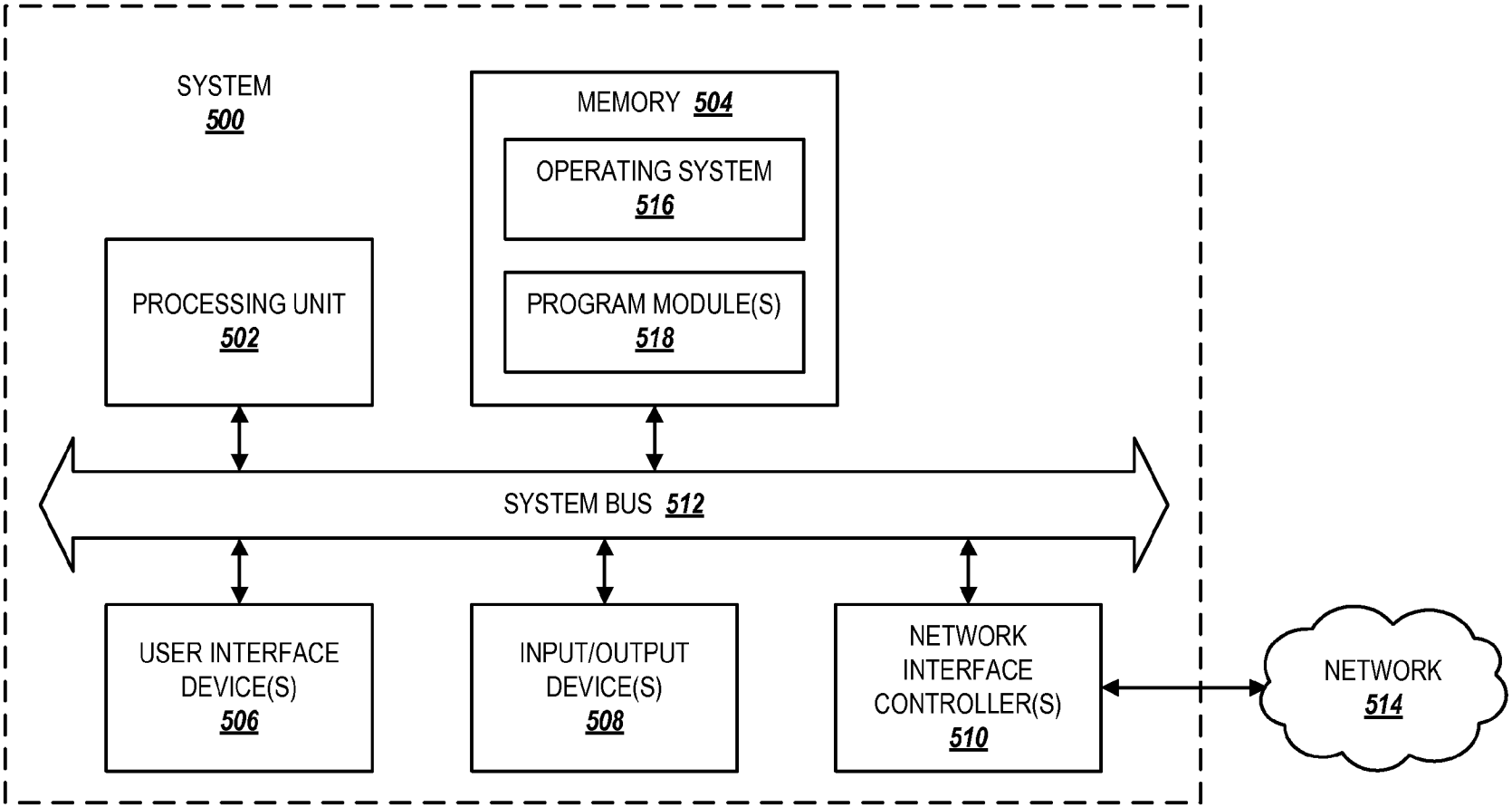
FIG. 5 is a block diagram showing an illustrative computer hardware and software architecture for a computing system capable of implementing aspects of the embodiments presented herein.

FIG. 5 is a block diagram illustrating a computer system 500 configured to identify potentially redundant alarms based on a statistical correlation between categories of alarms, in accordance with exemplary embodiments. Such a computer system 500 may be utilized to implement the statistical correlation module 120 described above in regard to FIG. 1. The computer system 500 includes a processing unit 502, a memory 504, one or more user interface devices 506, one or more input/output ("I/O") devices 508, and one or more network interface controllers 510, each of which is operatively connected to a system bus 512. The bus 512 enables bi-directional communication between the processing unit 502, the memory 504, the user interface devices 506, the I/O devices 508, and the network interface controllers 510.

The processing unit 502 may be a standard central processor that performs arithmetic and logical operations, a more specific purpose programmable logic controller ("PLC"), a programmable gate array, or other type of processor known to those skilled in the art and suitable for controlling the operation of the computer. Processing units are well-known in the art, and therefore not described in further detail herein.

The memory 504 communicates with the processing unit 502 via the system bus 512. In one embodiment, the memory 504 is operatively connected to a memory controller (not shown) that enables communication with the processing unit 502 via the system bus 512. The memory 504 includes an operating system 516 and one or more program modules 518, according to exemplary embodiments. Examples of operating systems, such as the operating system 516, include, but are not limited to, WINDOWS®, WINDOWS® CE, and WINDOWS MOBILE® from MICROSOFT CORPORATION, LINUX, SYMBIAN™ from SYMBIAN SOFTWARE LTD., BREW® from QUALCOMM INCORPORATED, MAC OS® from APPLE INC., and FREEBSD operating system. An example of the program modules 518 includes the statistical correlation module 120. In one embodiment, the program modules 518 are embodied in computer-readable media containing instructions that, when executed by the processing unit 502, performs the routine 200 for generating a list of potentially redundant alarms based on a statistical correlation between categories of alarms, as described in greater detail above in regard to FIG. 2. According to further embodiments, the program modules 518 may be embodied in hardware, software, firmware, or any combination thereof.

By way of example, and not limitation, computer-readable media may comprise computer storage media and communication media. Computer storage media includes volatile and non-volatile, removable and non-removable media implemented in any method or technology for storage of information such as computer-readable instructions, data structures, program modules, or other data. Computer storage media includes, but is not limited to, RAM, ROM, Erasable Programmable ROM ("EPROM"), Electrically Erasable Programmable ROM ("EEPROM"), flash memory or other solid state memory technology, CD-ROM, digital versatile disks ("DVD"), or other optical storage, magnetic cassettes, magnetic tape, magnetic disk storage or other magnetic storage devices, or any other medium which can be used to store the desired information and which can be accessed by the computer system 500.

The user interface devices 506 may include one or more devices with which a user accesses the computer system 500. The user interface devices 506 may include, but are not limited to, computers, servers, personal digital assistants, cellular phones, or any suitable computing devices. The I/O devices 508 enable a user to interface with the program modules 518. In one embodiment, the I/O devices 508 are operatively connected to an I/O controller (not shown) that enables communication with the processing unit 502 via the system bus 512. The I/O devices 508 may include one or more input devices, such as, but not limited to, a keyboard, a mouse, or an electronic stylus. Further, the I/O devices 508 may include one or more output devices, such as, but not limited to, a display screen or a printer.

The network interface controllers 510 enable the computer system 500 to communicate with other networks or remote systems via a network 514. Examples of the network interface controllers 510 may include, but are not limited to, a modem, a radio frequency ("RF") or infrared ("IR") transceiver, a telephonic interface, a bridge, a router, or a network card. The network 514 may include a wireless network such as, but not limited to, a Wireless Local Area Network ("WLAN") such as a WI-FI network, a Wireless Wide Area Network ("WWAN"), a Wireless Personal Area Network ("WPAN") such as BLUETOOTH, a Wireless Metropolitan Area Network ("WMAN") such a WiMAX network, or a cellular network. Alternatively, the network 514 may be a wired network such as, but not limited to, a Wide Area Network ("WAN") such as the Internet, a Local Area Network ("LAN") such as the Ethernet, a wired Personal Area Network ("PAN"), or a wired Metropolitan Area Network ("MAN").

Although the subject matter presented herein has been described in conjunction with one or more particular embodiments and implementations, it is to be understood that the embodiments defined in the appended claims are not necessarily limited to the specific structure, configuration, or functionality described herein. Rather, the specific structure, configuration, and functionality are disclosed as example forms of implementing the claims.

The subject matter described above is provided by way of illustration only and should not be construed as limiting. Various modifications and changes may be made to the subject matter described herein without following the example embodiments and applications illustrated and described, and without departing from the true spirit and scope of the embodiments, which is set forth in the following claims.

What is claimed is:

1. A method of identifying potentially redundant alarms in a plurality of alarms, comprising:

assigning an alarm category from a plurality of alarm categories to each alarm in the plurality of alarms;

identifying an incident interval, wherein a first alarm of the plurality of alarms is considered to have occurred coincidently with a second alarm of the plurality of alarms when a time of occurrence of the first alarm is within the incident interval before or after a time of occurrence of the second alarm;

computing a coefficient of correlation between each distinct pair of alarm categories in the plurality of alarm categories, wherein the coefficient of correlation indicates a probability that an alarm of a second category of the distinct pair of alarm categories occurs coincidentally within the plurality of alarms with an alarm of a first category of the distinct pair of alarm categories, given that the alarm of the first category has occurred;

identifying a threshold value of the coefficient of correlation; and constructing a list of potentially redundant alarms comprising distinct pairs of alarm categories having the coefficient of correlation computed for the distinct pair equal to or exceeding the threshold value of the coefficient of correlation.

2. The method of claim 1, further comprising sorting the plurality of alarms in order of the time of occurrence of each alarm.

3. The method of claim 1, further comprising:

identifying a minimum threshold of occurrences; and filtering from the plurality of alarms all alarms of a category having a number of occurrences of alarms of the category within the plurality of alarms less than the minimum threshold of occurrences.

4. The method of claim 1, wherein computing the coefficient of correlation between a distinct pair of alarm categories further comprises:

counting a number of coincidental occurrences of an alarm of the second category with an alarm of the first category in the plurality of alarms;

counting a number of occurrences of an alarm of the first category in the plurality of alarms; and dividing the number of the coincidental occurrences of an alarm of the second category with an alarm of the first category by the number of the occurrences of an alarm of the first category.

5. The method of claim 4, wherein the coefficient of correlation computed for each distinct pair of alarm categories is further weighted by the number of the occurrences of an alarm of the first category.

6. The method of claim 1, wherein the plurality of alarm categories includes an alarm category for each distinct alarm condition represented in the plurality of alarms.

7. The method of claim 1, wherein the plurality of alarm categories includes an alarm category for each distinct pair of alarm condition and device type represented in the plurality of alarms.

8. A system for identifying potentially redundant alarms in a plurality of alarms, comprising:

a memory for storing a program containing computer-executable instructions for identifying potentially redundant alarms in a plurality of alarms; and a processor functionally coupled to the memory, the processor being responsive to the computer-executable instructions and operative to:

sort a plurality of alarms in order of a time of occurrence of each alarm, assign one of a plurality of alarm categories to each of the plurality of alarms, compute a coefficient of correlation between each distinct pair of alarm categories in the plurality of alarm categories, wherein the coefficient of correlation indicates a probability that an alarm of a second category of the distinct pair of alarm categories occurs coincidentally within the plurality of alarms with an alarm of a first category of the distinct pair of alarm categories, given that the alarm of the first category has occurred, and wherein the alarm of the second category is considered to occur coincidently with the alarm of the first category when the time of occurrence of the alarm of the second category is within an incident interval before or after the time of occurrence of the alarm of the first category, and construct a list of potentially redundant alarms comprising distinct pairs of alarm categories having the coefficient of correlation computed for the distinct pair equal to or exceeding a threshold value.

9. The system of claim 8, wherein the processor is further operative to filter from the plurality of alarms all alarms of a category having a number of occurrences of alarms of the category within the plurality of alarms less than a minimum threshold of occurrences.

10. The system of claim 8, wherein computing the coefficient of correlation between a distinct pair of alarm categories further comprises:

counting a number of coincidental occurrences of an alarm of the second category with an alarm of the first category in the plurality of alarms;

counting a number of occurrences of an alarm of the first category in the plurality of alarms; and dividing the number of the coincidental occurrences of an alarm of the second category with an alarm of the first category by the number of the occurrences of an alarm of the first category.

11. The system of claim 10, wherein the coefficient of correlation computed for each distinct pair of alarm categories is further weighted by the number of the occurrences of an alarm of the first category.

12. The system of claim 8, wherein the plurality of alarm categories includes an alarm category for each distinct alarm condition represented in the plurality of alarms.

13. The system of claim 8, wherein the plurality of alarm categories includes an alarm category for each distinct pair of alarm condition and device type represented in the plurality of alarms.

14. A computer-readable storage medium having computer-executable instructions stored thereon that, when executed by a computer, cause the computer to:

assign an alarm category from a plurality of alarm categories to each alarm in a plurality of alarms;

compute a coefficient of correlation between each distinct pair of alarm categories in the plurality of alarm categories, wherein the coefficient of correlation indicates a probability that an alarm of a second category of the distinct pair of alarm categories occurs coincidentally within the plurality of alarms with an alarm of a first category of the distinct pair of alarm categories, given that the alarm of the first category has occurred, and wherein the alarm of the second category is considered to have occurred coincidently with the alarm of the first category when a time of occurrence of the alarm of the second category is within an incident interval before or after the time of occurrence of the alarm of the first category; and construct a list of potentially redundant alarms comprising distinct pairs of alarm categories having the coefficient of correlation computed for the distinct pair equal to or exceeding a threshold value.

15. The computer-readable storage medium of claim 14, having further computer-executable instructions that cause the computer to sort the plurality of alarms in order of the time of occurrence of each alarm.

16. The computer-readable storage medium of claim 14, having further computer-executable instructions that cause the computer to filter from the plurality of alarms all alarms of a category having a number of occurrences of alarms of the category within the plurality of alarms less than a minimum threshold of occurrences.

17. The computer-readable storage medium of claim 14, having further computer-executable instructions that cause the computer to:

count a number of coincidental occurrences of an alarm of the second category with an alarm of the first category in the plurality of alarms;

count a number of occurrences of an alarm of the first category in the plurality of alarms; and compute the coefficient of correlation between the distinct pair of alarm categories by dividing the number of the coincidental occurrences of an alarm of the second category with an alarm of the first category by the number of the occurrences of an alarm of the first category.

18. The computer-readable storage medium of claim 17, wherein the coefficient of correlation computed for the distinct pair of alarm categories is further weighted by the number of the occurrences of an alarm of the first category.

19. The computer-readable storage medium of claim 14, wherein the plurality of alarm categories includes an alarm category for each distinct alarm condition represented in the plurality of alarms.

20. The computer-readable storage medium of claim 14, wherein the plurality of alarm categories includes an alarm category for each distinct pair of alarm condition and device type represented in the plurality of alarms.

* * * * *